US006752664B2

(12) United States Patent
Hyland et al.

(10) Patent No.: US 6,752,664 B2
(45) Date of Patent: Jun. 22, 2004

(54) MODULAR JACK HAVING MAGNETIC MODULE WITH SUPPORT AND ALIGNMENT MECHANISM

(75) Inventors: James H. Hyland, Hummelstown, PA (US); Kevin E. Walker, Hershey, PA (US); Iosif R. Korsunsky, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/280,554

(22) Filed: Oct. 24, 2002

(65) Prior Publication Data

US 2004/0082223 A1 Apr. 29, 2004

(51) Int. Cl.[7] ..... H01R 24/00; H01R 13/66
(52) U.S. Cl. ..... 439/620; 439/676
(58) Field of Search ..... 439/620, 676

(56) References Cited

U.S. PATENT DOCUMENTS 5,069,641 A 12/1991 Sakamoto et al. ..... 439/620
5,647,767 A * 7/1997 Scheer et al. ..... 439/620
6,010,367 A * 1/2000 Wu ..... 439/620
6,116,963 A * 9/2000 Shutter ..... 439/676
6,227,911 B1 * 5/2001 Boutros et al. ..... 439/620
6,302,741 B1 * 10/2001 Fasold et al. ..... 439/620
6,319,064 B1 * 11/2001 Belopolsky et al. ..... 439/620
6,409,548 B1 * 6/2002 Guttierez ..... 439/676
6,540,564 B1 * 4/2003 Ko ..... 439/676
6,585,540 B2 * 7/2003 Guttierez et al. ..... 439/620
2003/0077941 A1 * 4/2003 Wojtacki et al. ..... 439/607
2003/0077942 A1 * 4/2003 Givens et al. ..... 439/620

* cited by examiner

*Primary Examiner*—Michael C. Zarroli
(74) *Attorney, Agent, or Firm*—Wei Te Chung

(57) ABSTRACT

A modular jack (100) in accordance with the present invention includes an insulative housing (1) defining a cavity for receiving a plug connector, a conductive shield (2) substantially surrounding the insulative housing and a insert assembly (10) installed in the cavity of the insulative housing. The insert assembly includes a magnetic module (3), a first printed circuit board (PCB, 4), a second PCB (5), and a grounding plate (9). A contact array (6) is soldered to the first PCB. The first PCB is attached on a bottom wall (312) of the magnetic module. The second PCB carries capacitors and resistors and a pair of LEDs (501, 502) soldered on a front portion thereof. The second PCB is attached on a top wall (311) of the magnetic module. The magnetic module defines a passageway (38) and the grounding plate has a flat portion (90) received therein.

9 Claims, 5 Drawing Sheets

MODULAR JACK HAVING MAGNETIC MODULE WITH SUPPORT AND ALIGNMENT MECHANISM

CROSS-REFERENCE TO RELATED APPLICATION

The present application is related to commonly assigned and contemporaneously filed U.S. patent applications with unknown serial numbers, entitled "MODULAR JACK HAVING IMPROVED GROUNDING PLATE", invented by James H. Hyland et al., and entitled "MODULAR JACK HAVING SUBASSEMBLY OF PCBS AND MAGNETIC BOX", invented by Kevin E. Walker et al.; Ser. No. 10/005,962, filed on Nov. 7, 2001, entitled "RJ MODULAR CONNECTOR HAVING GROUNDING MECHANISM", Ser. No. 10/040,754, filed on Dec. 28, 2001, entitled "ANTI CROSSTALK ELECTRICAL CONNECTOR AND METHOD OF MANUFACTURE THE SAME", Ser. No. 10/037,061, filed on Nov. 8, 2001, entitled "RJ MODULAR CONNECTOR HAVING SUBSTRATE HAVING CONDUCTIVE TRACE TO BALANCE ELECTRICAL COUPLINGS BETWEEN TERMINALS" and Ser. No. 10/037,706, filed on Dec. 29, 2001, entitled "RJ MODULAR CONNECTOR HAVING SUBSTRATE HAVING CONDUCTIVE TRACE TO BALANCE ELECTRICAL COUPLINGS BETWEEN TERMINALS", all invented by James H. Hyland. Copies of the specifications are hereto attached.

BACKGROUND OF THE INVENTION

1. Field of the Invention

The present invention relates to a modular jack, and particularly to a modular jack having a support protrusion formed on a magnetic module to support and align other components when the connector is assembled.

2. Description of Prior Art

U.S. Pat. No. 5,069,641, issued to Sakamoto on Dec. 3, 1991, discloses a modular jack assembly in which a choke coil and terminals are soldered to an internal circuit board. This internal circuit board subassembly is then encased in an insulative housing. The insulative housing comprises a base, a lid and two internal chambers. The internal circuit board subassembly is mounted in one chamber which is separated by a separator from the other chamber adapted to receive a plug connector. The lid is attached to encase the internal circuit board subassembly. As suggested by Sakamoto, the electronic parts needed in high speed application are mounted onto an internal circuit board first to become a subassembly. However, the subassembly is hard to be assembled into the connector housing because the surface of the board is difficult to be held and the solder joints of electronic parts may be hurt if the pushing force for assembling is applied on these parts directly.

Hence, an improved modular jack is required to overcome the disadvantages of the prior art.

BRIEF SUMMARY OF THE INVENTION

A main object of the present invention is to provide an improved modular jack having a protrusion formed on a magnetic module and used to support and align the inner printed circuit board (PCB) installed inside the connector when the PCB is inserted into the connector housing.

A modular jack in accordance with the present invention comprises an insulative housing defining a cavity for receiving a plug connector, a conductive shield substantially surrounding the insulative housing and a insert assembly received in the cavity of the insulative housing. The insert assembly comprises a magnetic module, a first PCB, a second PCB and a grounding plate. A contact array is soldered to the first PCB. The first PCB is attached on a bottom wall of the magnetic module. The second PCB carries capacitors and resistors and a pair of light emitting diodes (LEDs) soldered on a front portion thereof. The second PCB is attached on a top wall of the magnetic module. The magnetic module defines a passage and the grounding plate has a flat portion received therein.

Other objects, advantages and novel features of the invention will become more apparent from the following detailed description of the present embodiment when taken in conjunction with the accompanying drawings.

DETAILED DESCRIPTION OF THE INVENTION

Figure 1:
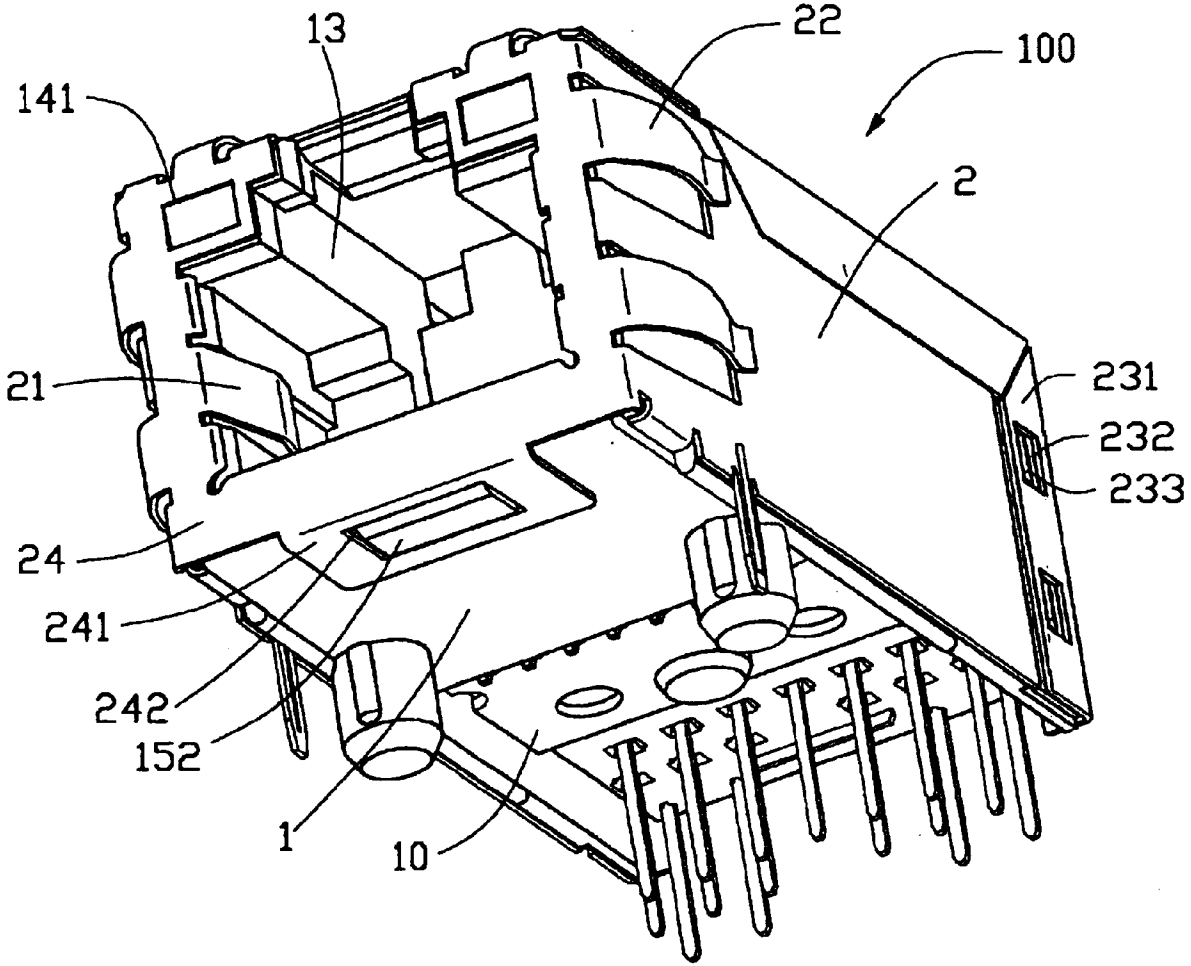
FIG. 1 is a perspective view of a modular jack in accordance with the present invention.

Referring to FIG. 1, a modular jack 100 for being mounted on a main printed circuit board (PCB, not shown) in accordance with the present invention comprises an insulative housing 1, a conductive shield 2 substantially surrounding the insulative housing 1 and a insert assembly 10 installed in the insulative housing 1.

Figure 2:
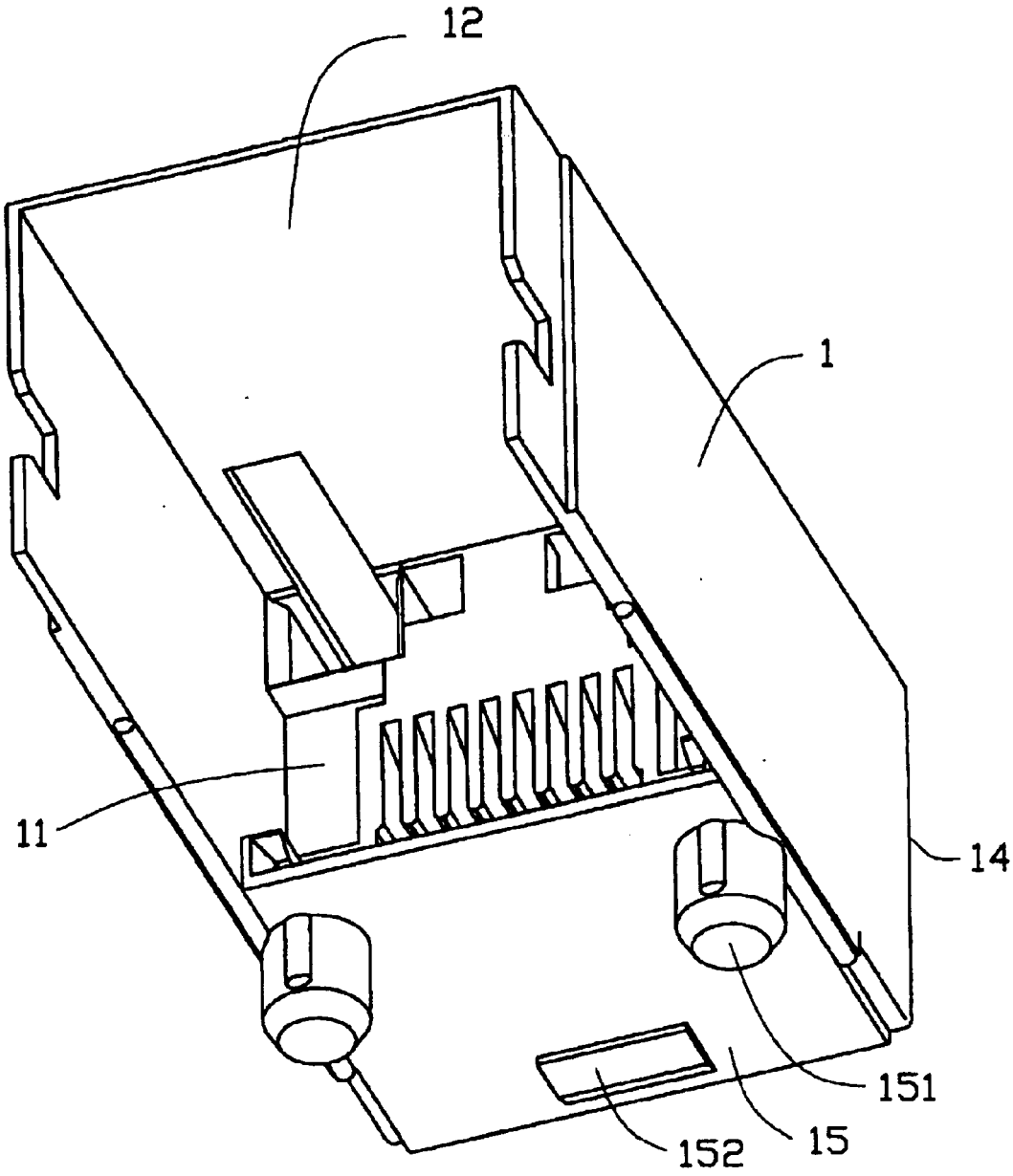
FIG. 2 is a perspective view of an insulative housing of the modular jack shown in FIG. 1.

Referring to FIGS. 1 and 2, the insulative housing 1 has a separator 11 which divides an interior space of the insulative housing 1 into a front chamber 13 and a rear chamber 12. The front chamber 13 receives a complementary plug (not shown). The rear chamber 12 receives the insert assembly 10. The housing 1 has a front wall 14 and a bottom wall 15. The front wall 14 defines a pair of light emitting diode (LED) receiving cavities 141 extending therethrough. The bottom wall 15 has two locating protrusions 151 formed thereon, and a wedge 152 formed on a front portion thereof.

The shield 2 has a plurality of flexible fingers 21 which are bent into the front chamber 13 for engaging with an outer shield of the complementary plug. The shield 2 also has a plurality of outwardly bent flexible fingers 22 for engaging with an appropriate support structure (not shown) within which the modular jack 100 may be mounted. The shield 2 has a pair of side walls (not labeled), a front shield wall 24 and a rear shield wall (not labeled). Each side wall forms a pair of wedges 233 on a rear portion thereof and the rear shield wall has a pair of flaps 231 each defining a pair of slots 232 engaging with corresponding wedges 233 of the side walls of the shield 2. The front shield wall 24 has a bottom flap 241 defining a slot 242 engaging with the wedge 152 of the housing 1 to secure the shield 2 to the housing 1.

Figure 3:
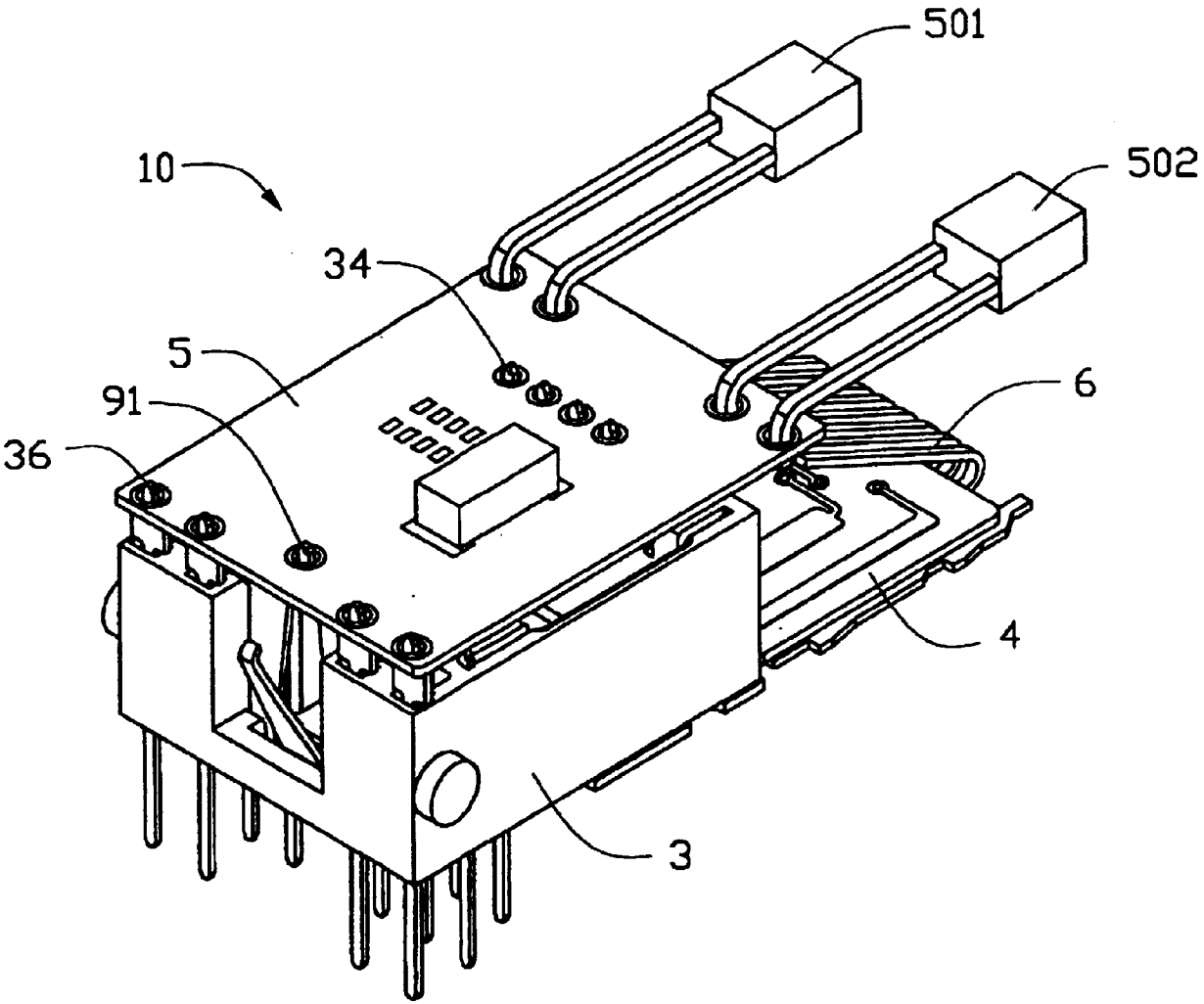
FIG. 3 is a perspective view of a insert assembly of the modular jack shown in FIG. 1.
Figure 4:
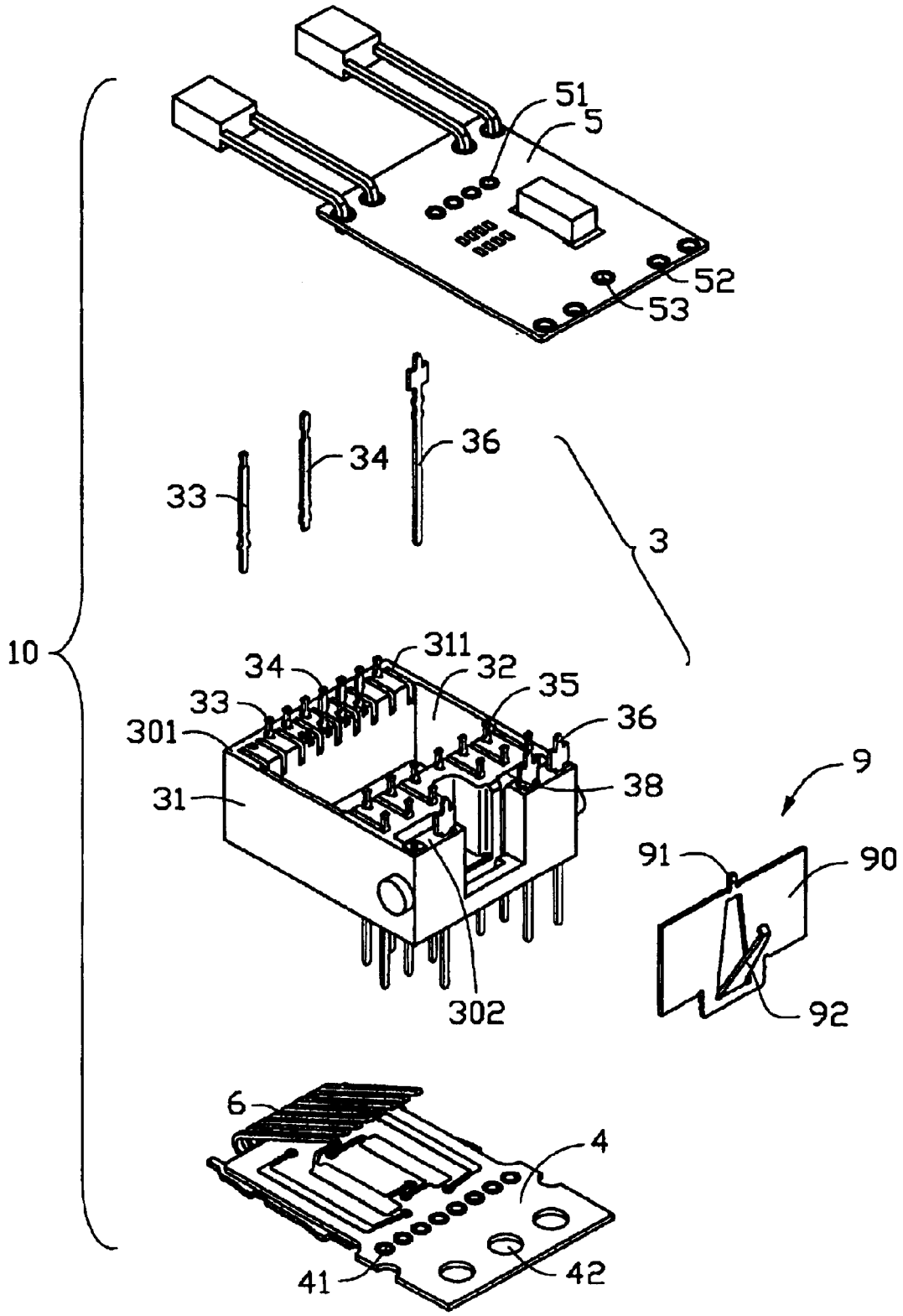
FIG. 4 is an exploded view of FIG. 3.
Figure 5:
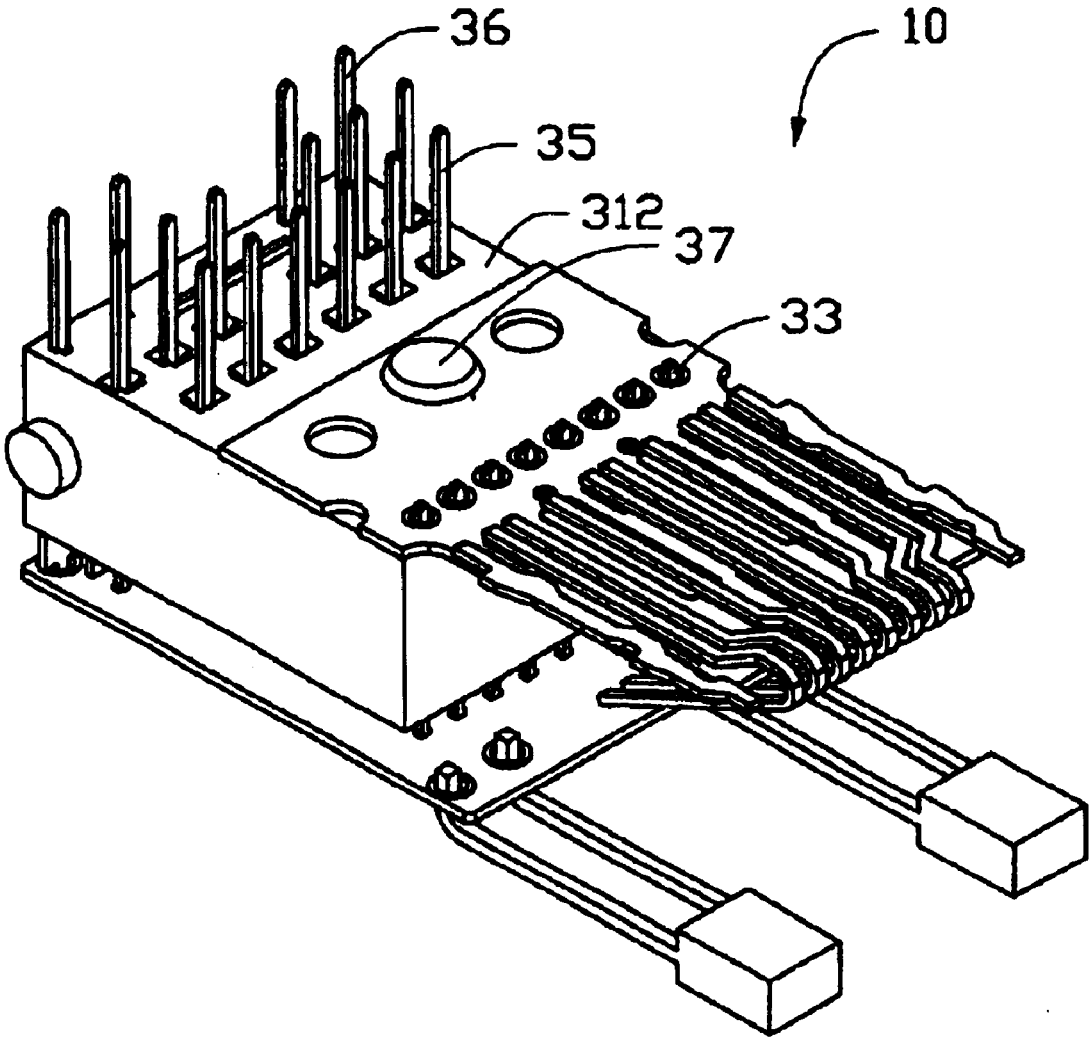
FIG. 5 is another perspective view of FIG. 3 taken from a bottom aspect.

Referring to FIGS. 3, 4 and 5, The insert assembly 10 comprises a magnetic module 3, a first PCB 4, a second PCB 5, a contact array 6, a pair of LEDs 501, 502 and a grounding plate 9. The contact array 6 is soldered to the first PCB 4. The first PCB 4 has a plurality of first soldering holes 41 and a holding hole 42 defined in a rear portion of the first PCB 4.

The second PCB 5 carries capacitors (not labeled), resistors (not labeled) and the pair of LEDs 501, 502 soldered thereon. The second PCB 5 also has a plurality of second soldering holes 51 adjacent to the LEDs 501, 502. A plurality of third soldering holes 52 are defined in a rear portion of the second PCB 5. A grounding hole 53 is defined between second soldering holes 51 and third soldering holes 52.

The magnetic module 3 has an insulative base 31. The base 31 has a top wall 311 and a bottom wall 312. A cavity 32 for housing magnetic coils (not shown) is defined in the base 31 and opens in the top wall 311. The cavity 32 divides the top wall 311 into a front side 301 and a rear side 302. A plurality of first pins 33 are fixed in the front side 301 and extend through top and bottom walls 311, 312 of the base 31. A plurality of second pins 34 which are longer than the first pins 33 are fixed adjacent to the first pins 33. A plurality of first terminals 35 and second terminals 36 which are longer than the first terminals 35 extend through the rear side 302 of the base 31. A passageway 38 for receiving the grounding plate 9 is defined in the rear side 302. At lease one protrusion 37 is formed on the middle portion of the bottom wall 312 and extends downwardly therefrom.

The grounding plate 9 has a flat portion 90 and a soldering portion 91 formed on a top edge of the flat portion 90. The soldering portion 91 is to be positioned in the grounding hole 53 of the second PCB 5 before the second PCB is soldered to the pins 33, 34 of the magnetic module 3. A connection beam 92 is bent rearward from the flat portion 90 and contacts the rear shield wall of the shield 2.

In assembly, The first PCB 4 is attached on the bottom wall 312 of the magnetic module 3 by soldering the plurality of first pins 33 to the first soldering holes 41 and inserting the protrusion 37 into the holding hole 42. The contact array 6 is soldered on the first PCB 4. The first PCB 4 cantilevers forward from the base 31. The second PCB 5 is disposed off from the top wall 311 of the magnetic module 3 by inserting pins 34, terminals 36 and soldering portion 91 of the grounding plate 9 into respective holes 51, 52 and 53. The insert assembly 10 is installed into the housing 1 so that the magnetic module 3, the first PCB 4 and the second PCB 5 are received in the rear chamber 12. The two LEDs 501, 502 and the contact array 6 extend into the front chamber 13 through separator 11. The two LEDs 501, 502 are inserted into corresponding LED receiving cavities 141. The contact array 6 electrically contacts terminals of the complementary plug, and the terminals 35, 36 fix the modular jack 100 on the main PCB and electrically connect proper circuit traces on the main PCB.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack comprising:

a housing defining a chamber for receiving a plug connector; and an insert assembly received in the cavity, the insert assembly having a printed circuit board (PCB) and a magnetic module with a protrusion formed thereon, the PCB having a plurality of contacts arranged thereon and a hole engaging with the protrusion of the magnetic module, whereby the insertion force applied to the magnetic module is transferred to the whole insert assembly by means of the protrusion; wherein the magnetic module has a top wall and a bottom wall, and the protrusion is formed on the bottom wall of the magnetic module so that the hole is able to engage with the protrusion of the magnetic module.

2. The modular jack as described in claim 1, wherein the magnetic module defines a cavity for receiving a plurality of magnetic coils.

3. The modular jack as described in claim 1, wherein the magnetic module has a grounding plate attached thereto.

4. The modular jack as described in claim 1, wherein the insert assembly also has a second PCB, the second PCB carries capacitors and resistors soldered thereon.

5. The modular jack as described in claim 4, wherein the second PCB disposed off from the top wall of the magnetic module.

6. The modular jack as described in claim 4, wherein the housing defines a front chamber and a rear chamber, the magnetic module attached with the first PCB and the second PCB are installed in the rear chamber, and the terminal contact portion extends into the front chamber.

7. The modular jack as described in claim 1, wherein said modular jack further comprises a shield substantially surrounding the housing.

8. A modular jack comprising:

a housing defining a cavity for receiving a plug connector; and an insert assembly received in the cavity, the insert assembly having a magnetic module with a protrusion formed thereon, the magnetic module having an insulative base with a top wall, a bottom wall and a pushing surface for a pushing force to be exerted on and the pushing force can be transferred to a front section of the insert assembly via the protrusion.

9. A modular jack comprising:

a housing defining a cavity for receiving a plug connector; and a terminal insert including:

a horizontal printed circuit board defining two opposite surfaces thereon, said printed circuit board providing guiding means on two opposite side edges thereof for guidable insertion of said terminal insert into the housing in a back-to-front direction; and a rectangular noise suppressing module secured to one of said two surfaces; wherein said noise suppressing module provides a relatively larger vertical plane, in comparison with the printed circuit board, rearwardly exposed to an exterior, so as to allow an insertion force to be applied thereunto when assembling; wherein another printed circuit board is assembled to the noise suppressing module spatially opposite to said printed circuit board in a parallel manner via said suppressing module.

* * * * *